US006330981B1

(12) United States Patent
Nally, Jr. et al.

(10) Patent No.: US 6,330,981 B1
(45) Date of Patent: Dec. 18, 2001

(54) FUEL INJECTOR WITH TURBULENCE GENERATOR FOR FUEL ORIFICE

(75) Inventors: John F. Nally, Jr., Williamsburg; William A. Peterson, Jr., Smithfield; Farid H. Miandoab, Virginia Beach; Hamid Sayar, Newport News, all of VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/259,716

(22) Filed: Mar. 1, 1999

(51) Int. Cl.[7] ..... F02M 61/00

(52) U.S. Cl. ..... 239/533.12; 239/553.3; 239/585.1; 239/585.4; 239/596

(58) Field of Search ..... 239/533.2, 533.11, 239/533.12, 553, 553.3, 584, 585.1, 585.4, 585.5, 590, 590.3, 596, 601

(56) References Cited

U.S. PATENT DOCUMENTS

| | | | | |
|---|---|---|---|---|
| 4,907,748 | * | 3/1990 | Gardner et al. | 239/590.3 X |
| 5,174,505 | | 12/1992 | Shen . | |
| 5,285,970 | * | 2/1994 | Maier et al. | 239/533.12 |
| 5,437,413 | | 8/1995 | Shen et al. . | |
| 5,449,114 | * | 9/1995 | Wells et al. | 239/596 X |
| 5,484,108 | * | 1/1996 | Nally | 239/585.4 X |
| 5,553,790 | * | 9/1996 | Findler et al. | 239/596 X |
| 5,570,841 | * | 11/1996 | Pace et al. | 239/533.12 X |
| 5,609,297 | | 3/1997 | Galdigow et al. . | |
| 5,636,796 | * | 6/1997 | Oguma | 239/596 X |
| 5,685,485 | | 11/1997 | Mock et al. . | |
| 5,685,491 | * | 11/1997 | Marks et al. | 239/533.12 |
| 5,711,281 | | 1/1998 | Lorraine . | |
| 5,716,001 | | 2/1998 | Wakeman et al. . | |
| 5,765,750 | | 6/1998 | Pace et al. . | |
| 5,899,390 | * | 5/1999 | Arndt et al. | 239/533.12 X |
| 6,168,099 | | 1/2001 | Hopf et al | 239/596 |

FOREIGN PATENT DOCUMENTS

| | | |
|---|---|---|
| 195 07 285 | 7/1995 | (DE) . |
| 195 03 269 | 8/1996 | (DE) . |
| 0 611 886 | 2/1994 | (EP) . |
| 0 750 110 | 12/1996 | (EP) . |
| WO 95/04881 | 2/1995 | (WO) . |

* cited by examiner

*Primary Examiner*—Andres Kashnikow
*Assistant Examiner*—Steven J. Ganey

(57) ABSTRACT

A fuel injection valve for an internal combustion engine includes an armature assembly including an injector needle reciprocable between a closed position and an open position; a needle seat for receiving the injector needle in the closed position, the needle seat including a central opening therethrough; a discharge orifice disk disposed downstream of the needle seat, the discharge orifice disk directing fuel toward a desired location; and a turbulence generator disposed upstream of the discharge orifice disk.

9 Claims, 3 Drawing Sheets

FUEL INJECTOR WITH TURBULENCE GENERATOR FOR FUEL ORIFICE

BACKGROUND OF THE INVENTION

The present invention relates in general to electromagnetic fuel injectors for internal combustion engines and, in particular, to the generation of fuel turbulence in such fuel injectors.

Increasingly stringent exhaust emission standards have driven the automotive industry to discover ways of achieving more complete combustion and thereby lower emissions. One way of achieving more complete combustion is by using fuel injectors with improved fuel atomization.

Fuel injectors typically comprise an electromagnetically actuated needle valve disposed in a fuel volume. The needle valve is reciprocated axially within the fuel volume in response to energization and deenergization of an actuator to selectively open and close a flow path through the fuel injector. Particularly, the valve body or housing defining the fuel volume has an aperture or orifice at one end forming a seat for the end of the needle valve whereby its reciprocating motion enables an intermittent flow of fuel through the orifice. Typically, the fuel emitted from a fuel injector is atomized downstream of the orifice to provide the necessary fuel/air mixture in the combustion chamber of the engine.

SUMMARY OF THE INVENTION

It is an object of the present invention to provide a fuel injector with improved atomization.

This and other objects of the invention are achieved by a fuel injection valve for an internal combustion engine comprising an armature assembly including an injector needle reciprocable between a closed position and an open position; a needle seat for receiving the injector needle in the closed position, the needle seat including a central opening therethrough; a discharge orifice disk disposed downstream of the needle seat, the discharge orifice disk directing fuel toward a desired location; and a turbulence generator disposed upstream of the discharge orifice disk.

The discharge orifice disk defines at least one opening therein for directing fuel toward the desired location.

In one embodiment, the turbulence generator comprises a first turbulence generator disk having a central opening smaller than the central opening in the needle seat and a second turbulence generator disk having a central opening at least as large as a diameter of a circle containing the at least one opening in the discharge orifice disk, the first turbulence generator disk disposed downstream of the needle seat and the second turbulence generator disk disposed downstream of the first turbulence generator disk.

In a second embodiment, the central opening in the needle seat is smaller than a diameter of a circle containing the at least one opening in the discharge orifice disk and the turbulence generator comprises a turbulence generator disk having a central opening at least as large as the diameter of the circle containing the at least one opening in the discharge orifice disk and wherein the turbulence generator disk is disposed downstream of the needle seat.

In a third embodiment, the turbulence generator comprises a first turbulence generator disk having a plurality of openings therein, the plurality of openings being aligned such that, when viewed in a longitudinal direction of the fuel injector, the plurality of openings at least partially overlap the at least one opening in the discharge orifice disk, and a second turbulence generator disk having a central opening at least as large as a diameter of a circle containing the at least one opening in the discharge orifice disk, the first turbulence generator disk disposed downstream of the needle seat and the second turbulence generator disk disposed downstream of the first turbulence generator disk.

In a fourth embodiment, the central opening in the needle seat is smaller than a diameter of a circle containing the at least one opening in the discharge orifice disk and the turbulence generator comprises a counterbore in the needle seat, the counterbore having a diameter at least as large as the diameter of the circle containing the at least one opening in the discharge orifice disk wherein the counterbore is downstream of the central opening in the needle seat.

Further objects, advantages and features of the invention will become apparent from the following detailed description taken in conjunction with the accompanying drawing.

DETAILED DESCRIPTION OF THE PREFERRED EMBODIMENTS

Figure 1:
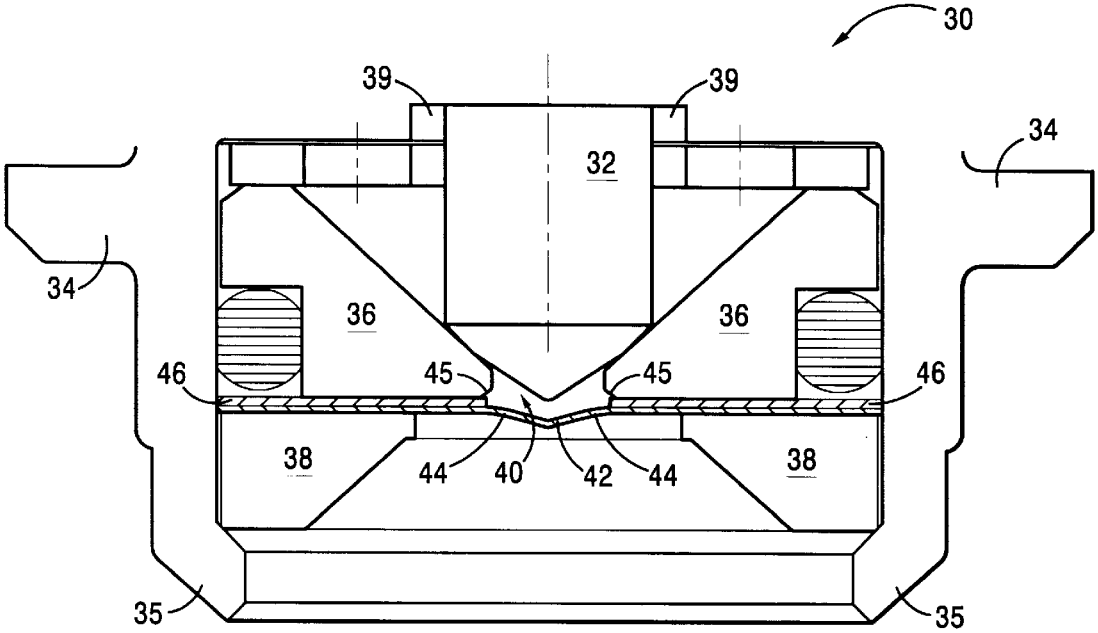
FIG. 1 is an enlarged sectional view of the bottom portion of one embodiment of a fuel injector according to the present invention.

The present invention is directed toward fuel injectors with improved fuel atomization as a means of achieving more complete combustion and thereby lower emissions. In general, the invention uses a turbulence generator upstream of the fuel injector discharge orifice disk to increase turbulence and thereby achieve finer atomization.

FIGS. 1–4 are enlarged sectional views of the bottom portion of fuel injectors according to the present invention. In FIGS. 1–4, like reference numerals refer to like features.

FIG. 1 shows a first embodiment of a fuel injector 30 according to the present invention. The fuel injector 30 includes a housing 34, an injector needle 32, a needle seat 36, a needle seat central opening 40, a discharge orifice disk 42, at least one opening 44 in the discharge orifice disk 42, a backup washer 38 and a turbulence generator in the form of a turbulence generator disk 46. The discharge orifice disk 42 may have one, two, three, four or more openings 44.

When the needle 32 is lifted, fuel flows through the central opening 40 of the seat 36 and through the at least one opening 44 of the discharge orifice disk 42. The discharge orifice disk directs the fuel toward a desired location. The turbulence generator disk 46 is sandwiched between the discharge orifice disk 42 and the needle seat 36. The backup washer 38 maintains the discharge orifice disk 42 and turbulence generator disk 46 in place. The housing 34 has a crimp 35 which holds the backup washer 38 in place.

In one preferred embodiment, the discharge orifice disk 42 includes four openings 44 of equal size in the shape of circles. The openings 44 are preferably equally spaced around the center of the discharge orifice disk 42.

In the embodiment shown in FIG. 1, the step 45 created between the central opening 40 of the seat 36 and the opening in the turbulence generator disk 46 generates turbulence in the fuel flowing towards the discharge orifice disk 42. The increased turbulence of the fuel increases atomization of the fuel and thereby increases combustion efficiency. The step 45 is created by making the diameter of the central opening 40 in the seat 36 smaller than the diameter of a circle containing the four openings 44 of the discharge orifice disk.

In the embodiment shown in FIG. 1, the turbulence generator disk 46 does not obstruct the flow of fuel through the openings 44 in the discharge orifice disk 42. That is, the central opening of the turbulence generator disk 46 is at least as large as the diameter of a circle containing the four openings 44 in the discharge orifice disk 42. Therefore, the disk 46 provides a fuel flow path to the openings 44.

Figure 2:
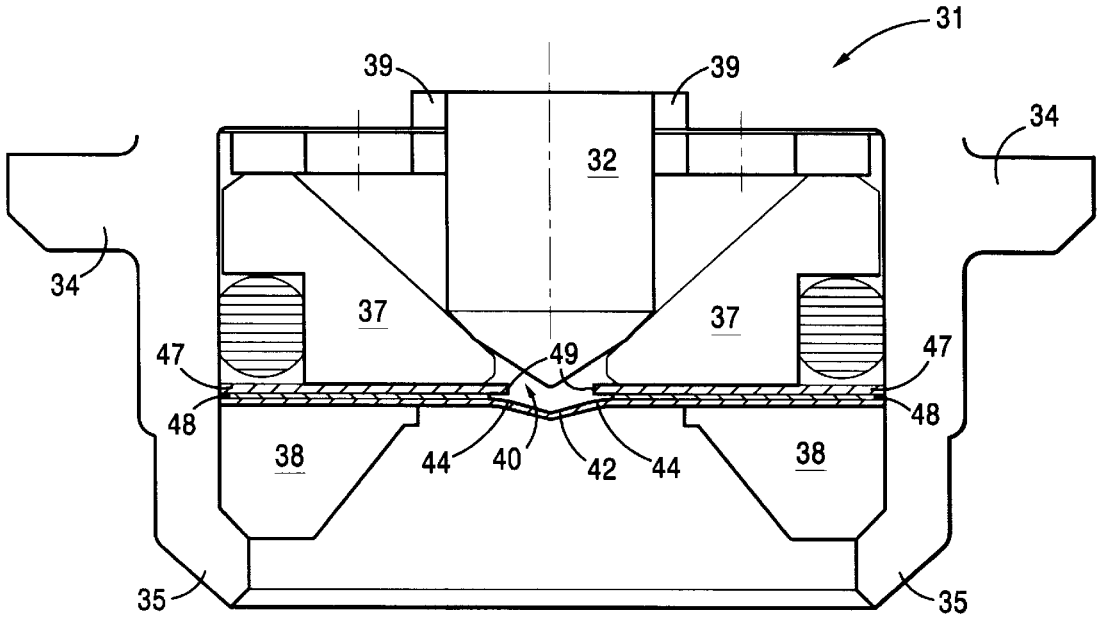
FIG. 2 is an enlarged sectional view of the bottom portion of a second embodiment of a fuel injector according to the present invention.

FIG. 2 shows a second embodiment of a fuel injector 31 according to the present invention. In FIG. 2, the turbulence generator comprises a first turbulence generator disk 47 disposed downstream of the needle seat 37 and a second turbulence generator disk 48 disposed downstream of the first turbulence generator disk 47. To provide a fuel path through the openings 44 of the discharge orifice disk 42, the second turbulence generator disk 48 has a central opening at least as large as a diameter of a circle containing the four openings 44 of the discharge orifice disk 42. In addition, the central opening 40 in the seat 37 is at least as large as the diameter of a circle containing the four openings 44 in the discharge orifice disk 42. The first turbulence generator disk 47 has a central opening smaller than the central opening 40 in the needle seat 36. Therefore, the first turbulence generator disk 47 provides a step or obstruction in the way of the fuel flow. The step 49 created by the disk 47 increases turbulence in the fuel flow and, thereby, increases fuel atomization and improves combustion efficiency.

Figure 3:
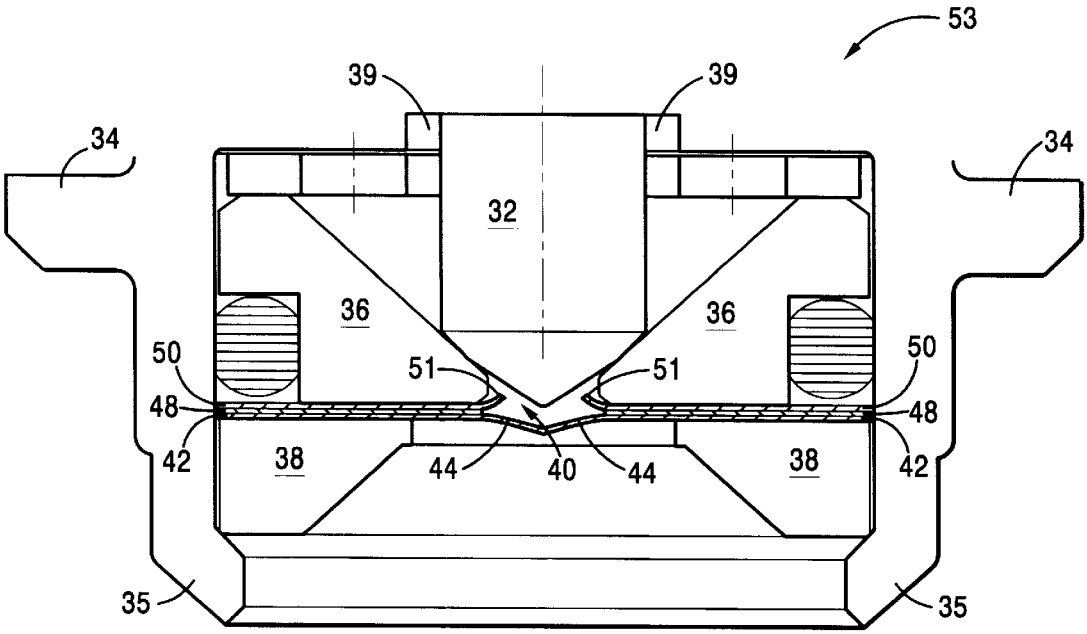
FIG. 3 is an enlarged sectional view of the bottom portion of a third embodiment of a fuel injector according to the present invention.

FIG. 3 shows a third embodiment of a fuel injector 53 according to the present invention. The embodiment of FIG. 3 is similar to the embodiment of FIG. 2 except that the first turbulence generator disk 50 is different. In FIG. 3, the perimeter of the central opening of the first turbulence generator disk 50 is bent or angled upstream. The angled portion 51 juts out into the fuel stream and generates turbulence.

Figure 4:
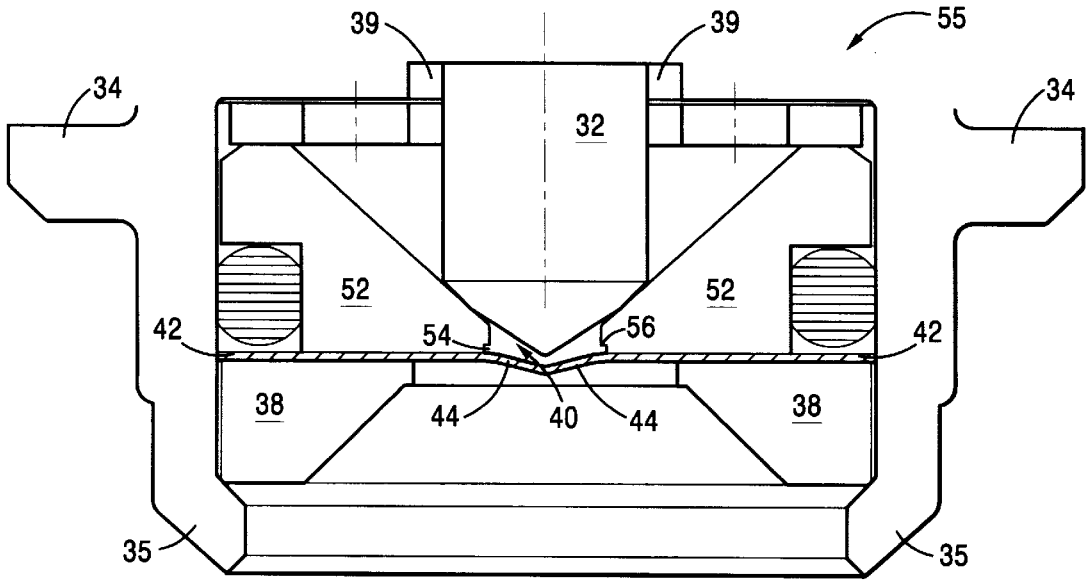
FIG. 4 is an enlarged sectional view of the bottom portion of a fourth embodiment of a fuel injector according to the present invention.

FIG. 4 shows a fourth embodiment of a fuel injector 55 according to the present invention. In FIG. 4, there are no separable turbulence generator disks. The central opening 40 of the needle seat 52 is smaller than a diameter of a circle containing the four openings 44 of the discharge orifice disk 42. Directly below the central opening 40 in the seat 52, the seat 52 includes a counterbore 54. A diameter of the central opening in the counterbore 54 is at least as large as the diameter of a circle containing the four openings 44 of the discharge orifice disk 42. Therefore, the counterbore 54 provides a flow passage for the fuel to the discharge orifice disk. The step 56 created by the counterbore 54 generates turbulence in the fuel.

The turbulence disks may be made of, for example, 302 stainless steel.

FIGS. 5–8 schematically represent different sizes of the central opening 40 in the needle seat 36 or, alternatively, the central opening in the first turbulence generator disk 47, in relation to the openings 44 in the discharge orifice disk 42. The solid line 60 in FIGS. 5–8 represents either the central opening 40 in the seat 36 or the central opening in the first turbulence generator disk. The dotted lines in FIGS. 5–11 represent the four openings 44 in the discharge orifice disk 42.

In embodiments where the circle 60 represents the opening in the first turbulence generator disk 47, it should be understood that a second turbulence generator disk 48 must be inserted between the first turbulence generator disk and the discharge orifice disk. The second turbulence generator disk would have an opening at least as large as a circle containing the four openings 44 of the discharge orifice disk 42 to provide a fuel flow path to the openings 44. In embodiments where the circle 60 represents the needle seat central opening 40, it will be understood that downstream of the central opening 40, either the seat is counterbored to a diameter to provide free flow through the openings 44 or a turbulence generator disk is inserted below the seat wherein the turbulence generator disk has a central opening to provide a free flow of fuel through the openings 44.

Figure 5:
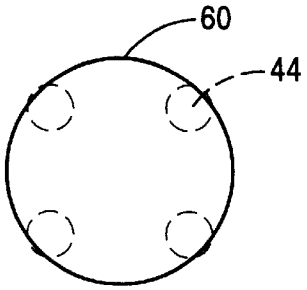
FIGS. 5–11 schematically show the relationship between various size openings in the turbulence generator and the openings in the discharge orifice disk of a fuel injector according to the present invention.
Figure 6:
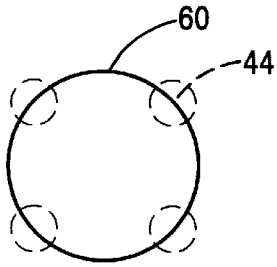
Figure 7:
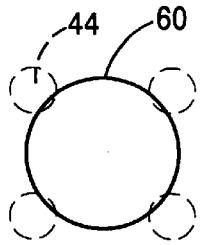
Figure 8:
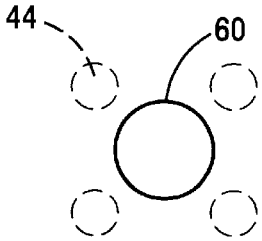

As shown in FIG. 5, only a small portion of the openings 44 in the discharge orifice disk 42 are masked. In FIGS. 6 and 7, increasingly larger amounts of the openings 44 are masked. In FIG. 8, the openings 44 are completely masked. In general, the greater the amount of masking, the greater the amount of turbulence that is generated.

Figure 9:
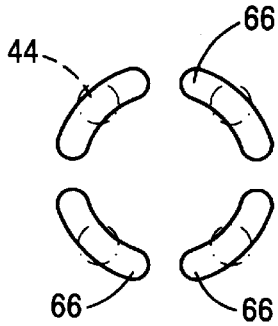
Figure 10:
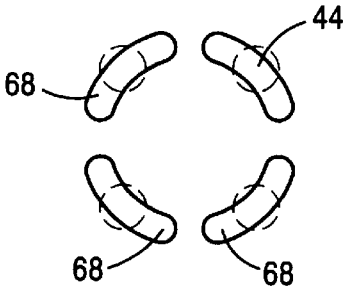
Figure 11:
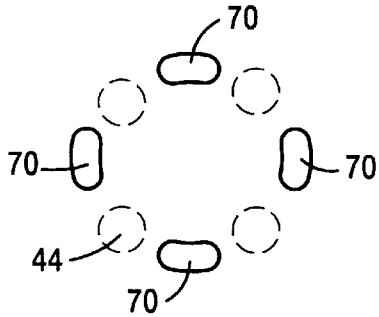

The present invention also contemplates a turbulence generator disk having a plurality of openings rather than a single central opening. FIGS. 9–11 schematically show embodiments of the invention wherein the first turbulence generator disk includes a plurality of openings. In FIG. 9, the plurality of openings 66 formed in the first turbulence generator disk are aligned such that, when viewed in a longitudinal direction of the fuel injector, the plurality of openings 66 at least partially overlap the four openings 44 in the discharge orifice disk 42. It will be understood that in each of the embodiments shown in FIGS. 9–11, a second turbulence generator disk disposed downstream of the first turbulence generator disk has a central opening at least as large as a diameter of a circle containing the four openings 44 in the discharge orifice disk 42 so that a free fuel flow path is established.

The embodiment of FIG. 10 is similar to the embodiment of FIG. 9 in that the openings 68 in the first turbulence generator disk have a reniform shape but are somewhat "slimmer" than in FIG. 9.

In the embodiment shown in FIG. 11, the openings 70 in the first turbulence generator disk are aligned such that, when viewed in a longitudinal direction of the fuel injector, the openings 70 do not overlap at all the four openings 44 in the discharge orifice disk 42.

In the embodiments shown in FIGS. 9–11, center lines of the four openings 66, 68, 70, respectively, of the first turbulence generator disk define a circle such that, when viewed in a longitudinal direction of the fuel injector, the circumference of the circle overlaps the center points of the four openings 44 in the discharge orifice disk 42. FIGS. 9–11 show four openings 66, 68, 70 having a generally reniform shape, however, it will be understood that less than four or more than four openings may be used and the openings may assume a variety of shapes. The test for a successful turbulence generator is that it generates turbulence in the fuel prior to fuel discharge through the discharge orifice disk 42.

While the invention has been disclosed with reference to certain preferred embodiments, numerous modifications, alterations and changes to the described embodiments are possible without departing from the sphere and scope of the invention, as defined in the appended claims and equivalents thereof.

What is claimed is:

1. A fuel injection valve for an internal combustion engine, comprising:

an armature assembly including an injector needle reciprocable between a closed position and an open position:

a needle seat for receiving the injector needle in the closed position, the needle seat including a central opening therethrough;

a discharge orifice disk disposed downstream of the needle seat, the discharge orifice disk having at least one opening directing fuel toward a desired location; and a turbulence generator disposed upstream of the discharge orifice disk, the turbulence generator including:

a first turbulence generator disk having a central opening smaller than the central opening in the needle seat, the first turbulence generator disk disposed downstream of the needle seat, a perimeter of the central opening in the first turbulence generator disk is angled upstream from a remainder of the first turbulence generator disk, and a second turbulence generator disk having a central opening at least as large as a diameter of a circle containing the at least one opening in the discharge orifice disk, the second turbulence generator disk being disposed downstream of the first turbulence generator disk.

2. The fuel injection valve of claim 1 wherein the central opening in the needle seat is at least as large as a diameter of a circle containing the at least one opening in the discharge orifice disk.

3. The fuel injection valve of clai 1 wherein the discharge orifice disk defines a plurality of openings of equal size and circular in shape.

4. A fuel injection valve for an internal combustion engine, comprising:

an armature assembly including an injector needle reciprocable between a closed position and an open position;

a needle seat for receiving the injector needle in the closed position, the needle seat including a central opening therethrough;

a discharge orifice disk disposed downstream of the needle seat, the discharge orifice disk defining at least one opening therein for directing fuel toward a desired location; and a turbulence generator disposed upstream of the discharge orifice disk, the turbulence generator including a first turbulence generator disk having a plurality of openings therein, the plurality of openings being aligned such that, when viewed in a longitudinal direction of the fuel injector, the plurality of openings at least partially overlap the at least one opening in the discharge orifice disk, and a second turbulence generator disk having a central opening at least as large as a diameter of a circle containing the at least one opening in the discharge orifice disk, the first turbulence generator disk disposed downstream of the needle seat and the second turbulence generator disk disposed downstream of the first turbulence generator disk.

5. The fuel injection valve of claim 4 wherein the plurality of openings comprise four openings, the four openings of the first turbulence generator disk being aligned such that, when viewed in a longitudinal direction of the fuel injector, each of the four openings of the first turbulence generator disk at least partially overlaps the at least one opening in the discharge orifice disk.

6. The fuel injection valve of claim 5 wherein the four openings of the first turbulence generator disk have a reniform shape.

7. The fuel injection valve of claim 5 wherein the discharge orifice disk defines a plurality of openings and center lines of the four openings of the first turbulence generator disk define a circle such that, when viewed in a longitudinal direction of the fuel injector, a circumference of the circle overlaps cneter points of the plurality of openings in the discharge orifce disk.

8. A fuel injection valve for an internal combustion engine, comprising:

an armature assembly including an injector needle reciprocable between a closed position and an open position;

a needle seat for receiving the injector needle in the closed position, the needle seat including a central opening therethrough;

a discharge orifice disk disposed downstream of the needle seat, the discharge orifice disk defining a plurality of openings therein for directing fuel toward a desired location; and a turbulence generator disposed upstream of the discharge orifice disk, the turbulence generator including a first turbulence generator disk haivng four openings therein, the four openings being aligned such that, when viewed in a longitudinal direction of the fuel injector, the four openings do not overlap the plurality of openings in the discharge orifice disk, a second turbulence generator disk having a central opening at least as large as a diameter of a circle containing the plurality of openings in the discharge orifice disk, the first turbulence generator disk diposed downstream of the needle seat and the second turbulence generator disk disposed downstream of the first turbulence generator disk, and center lines of the four openings of the first turbulence generator disk define a circle such that, when viewed in a longitudinal direction of the fuel injector, a circumference of the circle overlaps center points of the plurality of openings in the discharge orifice disk.

9. A fuel injection valve for an internal combustion engine, comprising:

an armature assembly including an injector needle reciprocable between a closed position and an open position;

a needle seat for receiving the injector needle in the closed position, the needle seat including a central opening therethrough;

a discharge orifice disk disposed downstream of the needle seat, the discharge orifice disk defining at least one opening therein for directing fuel toward a desired location, wherein the central opening in the needle seat is smaller than a diameter of a circle containing the at least one opening in the discharge orifice disk; and a turbulence generator disposed upstream of the discharge orifice disk, the turbulence generator comprises a counterbore in the needle seat, the counterbore having a diameter at least as large as the diameter of the circle containing the at least one opening in the discharge orifice disk, wherein the counterbore is downstream of the central opening in the needle seat.

* * * * *